US007268731B2

(12) United States Patent
Chiang et al.

(10) Patent No.: US 7,268,731 B2
(45) Date of Patent: Sep. 11, 2007

(54) MULTI-BAND ANTENNA FOR WIRELESS APPLICATIONS

(75) Inventors: Bing Chiang, Melbourne, FL (US); Michael J. Lynch, Merritt Island, FL (US); Douglas H. Wood, Palm Bay, FL (US)

(73) Assignee: IPR Licensing, Inc., Wilmington, DE (US)

( * ) Notice: Subject to any disclaimer, the term of this patent is extended or adjusted under 35 U.S.C. 154(b) by 0 days.

(21) Appl. No.: 10/895,813

(22) Filed: Jul. 20, 2004

(65) Prior Publication Data

US 2005/0057410 A1 Mar. 17, 2005

Related U.S. Application Data

(60) Provisional application No. 60/489,149, filed on Jul. 21, 2003.

(51) Int. Cl.
*H01Q 1/24* (2006.01)

(52) U.S. Cl. ..... 343/702; 343/700 MS

(58) Field of Classification Search ..... 343/700 MS, 343/906, 739, 702
See application file for complete search history.

(56) References Cited

U.S. PATENT DOCUMENTS 3,736,591 A 5/1973 Rennels et al. ..... 343/702
4,491,978 A 1/1985 Nagata et al. ..... 455/338
5,510,802 A * 4/1996 Tsuru et al. ..... 343/700 MS
5,757,326 A * 5/1998 Koyama et al. ..... 343/702
5,917,450 A * 6/1999 Tsunekawa et al. .. 343/700 MS
6,061,025 A * 5/2000 Jackson et al. ..... 343/700 MS
6,114,996 A * 9/2000 Nghiem ..... 343/700 MS
6,630,909 B2 10/2003 Nepveu ..... 343/744
6,680,704 B2 1/2004 Cassel et al. ..... 343/700 MS (Continued)

FOREIGN PATENT DOCUMENTS

DE 20106 005 U1 8/2001

(Continued)

OTHER PUBLICATIONS

Bowling, D.R., et al., "A Three-element Superdirective Array of Electrically Small, High-temperature Superconducting Half-loops at 500-MHz," Antennas and Propagation Society International Symposium, 1993. AP-S. Digest Ann Arbor, MI, USA Jun. 28-Jul. 2, 1993, New York<NY, USA, IEEE, Jun. 28, 1993 pp. 1846-1849.

*Primary Examiner*—Trinh Dinh
*Assistant Examiner*—Tung Le
(74) *Attorney, Agent, or Firm*—Volpe and Koenig, P.C.

(57) ABSTRACT

A folded monopole antenna that supports lower and upper frequency bands may be used in CDMA, WLAN, or other wireless communications systems. The folded monopole antenna may be located in a handset next to a vertical ground plane. The folded monopole antenna may be folded at least twice and connected to the ground plane through a reactance. The dimensions of different sections of the folded monopole antenna define lower and upper frequency band characteristics, and an offset location of an input feed affects the bandwidth of the frequency bands. The reactance between the antenna and ground plane can be selected to fine tune the frequency bands. Various input feeds, including a co-planar waveguide, may be employed. Dynamically adjustable reactances may be used in the input feed and ground line for adapting the antenna to various environments.

49 Claims, 15 Drawing Sheets

U.S. PATENT DOCUMENTS

| | | | | |
|---|---|---|---|---|
| 6,683,575 | B2 * | 1/2004 | Sekine et al. | 343/702 |
| 6,795,028 | B2 * | 9/2004 | Stutzman et al. | 343/702 |
| 6,950,065 | B2 * | 9/2005 | Ying et al. | 343/700 MS |
| 2002/0186169 | A1 * | 12/2002 | Iwai et al. | 343/702 |
| 2004/0027288 | A1 * | 2/2004 | Okubora et al. | 343/700 MS |
| 2004/0125025 | A1 * | 7/2004 | Stutzman et al. | 343/702 |
| 2005/0225496 | A1 * | 10/2005 | Apostolos et al. | 343/850 |
| 2006/0017620 | A1 * | 1/2006 | Chen et al. | 343/700 MS |
| 2006/0055606 | A1 * | 3/2006 | Boyle | 343/702 |

FOREIGN PATENT DOCUMENTS

| | | | |
|---|---|---|---|
| WO | WO 00/65688 | A1 | 11/2000 |
| WO | WO 02/091520 | A1 | 11/2002 |
| WO | WO 2004/077604 | A2 | 9/2004 |

* cited by examiner

MULTI-BAND ANTENNA FOR WIRELESS APPLICATIONS

RELATED APPLICATION(S)

This application claims the benefit of U.S. Provisional Application No. 60/489,149, filed on Jul. 21, 2003. The entire teachings of the above application are incorporated herein by reference.

BACKGROUND OF THE INVENTION

Code division multiple access (CDMA) communications systems, such as the communications system 100 of FIG. 1, provide wireless communications between a base station 110 and one or more mobile or portable subscriber units, such as a cell phone 130, Personal Digital Assistant (PDA) 140, or Portable Computer (PC) 135 with cellular modem. The base station is typically a computer-controlled set of transceivers that are interconnected to a land-based Public Switched Telephone Network (PSTN) 112 that is connected to a Wide Area Network (WAN) 115, such as the Internet, via a gateway (not shown).

The base station further includes an antenna apparatus 105 for sending forward link radio frequency signals 150*a* to the mobile subscriber units and for receiving reverse link radio frequency signals 150*b* transmitted from each mobile subscriber unit. Each mobile subscriber unit also contains an antenna apparatus for the reception of the forward link signals and for the transmission of the reverse link signals. Similar communications techniques are found in Wireless Local Area Networks (WLAN's) 117, where a network router 120 connects wireless access points 125 to the WAN 115. In either the CDMA or WLAN system, multiple mobile subscriber units may transmit and receive signals on the same center frequency, but unique modulation codes distinguish the signals sent to or received from individual subscriber units.

In addition to CDMA, other wireless access techniques employed for communications between a base station and one or more portable or mobile units include those described by the Institute of Electrical and Electronics Engineering (IEEE) 802.11 standard, optionally used in the WLAN 117, and the industry-developed wireless Bluetooth standard. All such wireless communications techniques require the use of an antenna at both the receiving and transmitting site. It is well-known by experts in the field that increasing the antenna gain in any wireless communications system has beneficial effects.

A common antenna for transmitting and receiving signals at a mobile subscriber unit is a monopole antenna (or any other antenna with an omni-directional radiation pattern). A monopole antenna consists of a single wire or antenna element that is coupled to a transceiver within the subscriber unit. Analog or digital information for transmission from the subscriber unit is input to the transceiver where it is modulated onto a carrier signal at a frequency using a modulation code, in the case of the CDMA system, assigned to that subscriber unit. The modulated carrier signal is transmitted from the subscriber unit antenna to the base station. Forward link signals received by the subscriber unit antenna are demodulated by the transceiver and supplied to processing circuitry within the subscriber unit.

SUMMARY OF THE INVENTION

According to the principles of the present invention, a folded monopole antenna includes three planar sections. The first planar section has a first dimension substantially defining a first resonance frequency supported by the folded monopole antenna. This first dimension, in one embodiment, is the height. A second planar section is substantially parallel to the first planar section. The first and second planar sections have respective first and second dimensions substantially defining a second resonance frequency supported by the folded monopole antenna. A third section connects the first planar section to the second planar section. To create the first, second, and third sections, a metal sheet may be folded twice at 90 degree angles. An input feed may be coupled to the first planar section at a first location and adapted to feed Radio Frequency (RF) signals to or from the folded monopole antenna and an external device, such as a transceiver. A distance (i.e., offset) between the first location and a centerline of the first planar section contributes to a first bandwidth at the first resonance frequency. For example, the bandwidth is narrower when the input feed is at the centerline than when the input feed is a far distance from the centerline. A reactance is adapted to couple the second planar section and a ground plane at a second location of the second planar section. A distance (i.e., offset) between the first and second locations from a centerline of the first and second planar sections contributes to a second bandwidth supported by the folded monopole antenna at the second resonance frequency.

Various embodiments of the folded monopole antenna are possible. For example, the reactance may be selectable between and including a short and an open to fine tune the second resonance frequency. The reactance may be selectable during operation of the folded monopole antenna. The reactance may also include multiple reactances distributed between the second planar section and the ground plane. In the case of multiple reactances, multiple respective switches may be used to selectively couple the second planar section and the ground plane at least one selectable location.

The input feed may be among multiple input feeds distributed on the first planar section. In the case of multiple input feeds, the folded monopole antenna may include respective switches to enable the input feeds. The input feed may also include a reactance (i.e., imaginary part) for input matching, optionally adjustable before or during operation. The input feed may be a co-planar waveguide. A mechanism may be associated with the co-planar waveguide to adjustably configure the co-planar waveguide to change a radiation resistance (i.e., real part) of the co-planar waveguide for input impedance matching.

The first bandwidth may include 900 MHz, and the second bandwidth may include 1.85 GHz. In another embodiment, the first bandwidth includes 2.4 GHz, and the second bandwidth includes 5.2 GHz.

The folded monopole antenna may be used in a handheld or portable wireless communications device, for use in a Wireless Local Area Network (WLAN), including cell phones, Personal Digital Assistants (PDA's), and laptop Personal Computers (PC's).

Corresponding methods and methods of manufacturing are also within the scope of the principles of the present invention.

BRIEF DESCRIPTION OF THE DRAWINGS

The foregoing and other objects, features and advantages of the invention will be apparent from the following more particular description of preferred embodiments of the invention, as illustrated in the accompanying drawings in which like reference characters refer to the same parts throughout the different views. The drawings are not necessarily to scale, emphasis instead being placed upon illustrating the principles of the invention.

DETAILED DESCRIPTION OF THE INVENTION

Figure 1:
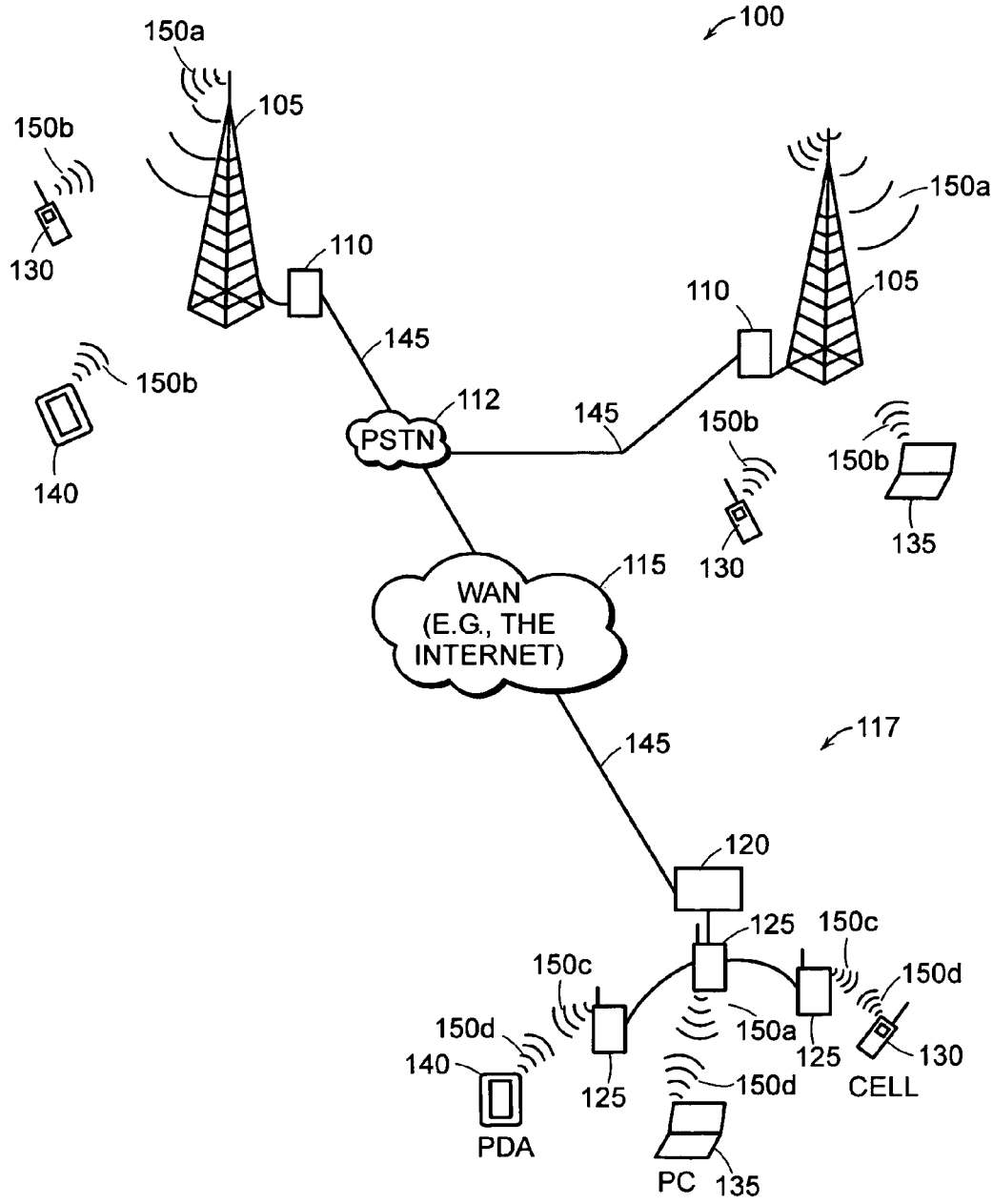
FIG. 1 is an example network diagram in which a folded monopole antenna according to the principles of the present invention may be employed.

A description of preferred embodiments of the invention follows.

The wireless handset industry is constantly seeking ways to optimize antennas to fit their applications. A common problem is how to fit the antenna into a small structure that is appealing to the consumer. The available size and shape of the space is often very restrictive. Another problem is fragmentation of available frequency bands to a particular spectrum owner, and the antenna has to work at these frequencies, singular or multiple. In order to provide possibility for performance upgrade, the antenna should be able to provide diversity, selectivity, or smartness.

A chosen starting point for one embodiment of the invention is a monopole, but the techniques described herein may be applied, in another embodiment of the invention, to a dipole, or a loop. In order to satisfy the ultimate physical rule governing electrically small antennas, the final product is essentially the same, regardless its starting point.

Various techniques may be used to design, manufacture, and use an antenna according to the above criteria. For example, the following techniques may be applied:

- An electrically small antenna has its radiation resistances reaching extremes, either very low or very high. In the case of a monopole, it is very low. A technique to increase it is to have a folded counterpart, or a folded monopole structure.
- To support a wider bandwidth, the antenna width is increased.
- To achieve maximum gain and bandwidth of an electrically small antenna, the folded structure and its width may fill the available volume.
- For a handset, its physical surface and volume are many times larger than that allotted for the antenna. That larger surface or volume can be utilized as the ground for the antenna. In so doing, the antenna system is larger, or may no longer be electrically small, and the radiation efficiency or gain-bandwidth product is improved.
- At the feed area, a co-planar waveguide can be used to locate the feed point at the interior of the antenna. This can locate the feed point at the optimum radiation center or can tailor the input impedance to the desired value.
- A reactance can be added along the feed line to further tune the input impedance for dual band or multiple bands.
- A reactance can be added to the grounded portion of the folded monopole. This has an effect of changing the effective length of the antenna, e.g., inductive coupling adds length and capacitive coupling reduces length. The effective length directly controls the resonance frequency or frequencies.
- Center the feed at the midpoint of the width of the antenna. That gives a broad resonance at the fundamental resonance of the antenna and also a broad resonance at the second harmonic.
- Locating the feed toward the edge along the width of the antenna changes the ratio of the fundamental frequency to the second frequency. This allows for customizing the multiple frequencies.
- The antenna's ground portion, which extends into other parts of the handset, is preferably sufficiently large. Sufficiently large refers to its size being larger than that needed to support the fundamental resonance. When it is large, the resonance frequencies of the antenna are not sensitive to external factors, such as when the handset is touched or held by the user. The unwanted frequency shift is often a major factor that determines the antenna's usefulness.

In one embodiment, the design, when properly dimensioned, produces the following result: it creates two low bands and two high bands. The two low bands together occupy a 15% band, and the two high bands occupy a 5% band. The high band is 2.4 times higher than the low band. It points to the fact that the high band is not a true second harmonic of the low band. The frequency offset is the outcome of the feed point offset from a centerline (i.e., width center) of the section of the monopole an input feed is disposed. In another prototype, where the feed is not offset to the side, the frequency ratio is much closer to 2:1. The bandwidth is defined as the input impedance bandwidth rather than the gain bandwidth. The in-band region is the region where the input impedance has better than −6 dB mismatch. Impedance bandwidth is used because the beam is broad, so it is difficult to define a beam.

Techniques outlined above may be employed to produce diversified patterns, suitable for smart antenna implementation. Because of the compact size, the folded monopole antenna according to one embodiment of the invention is ideally suited for use in the subscriber unit.

Figure 2A:
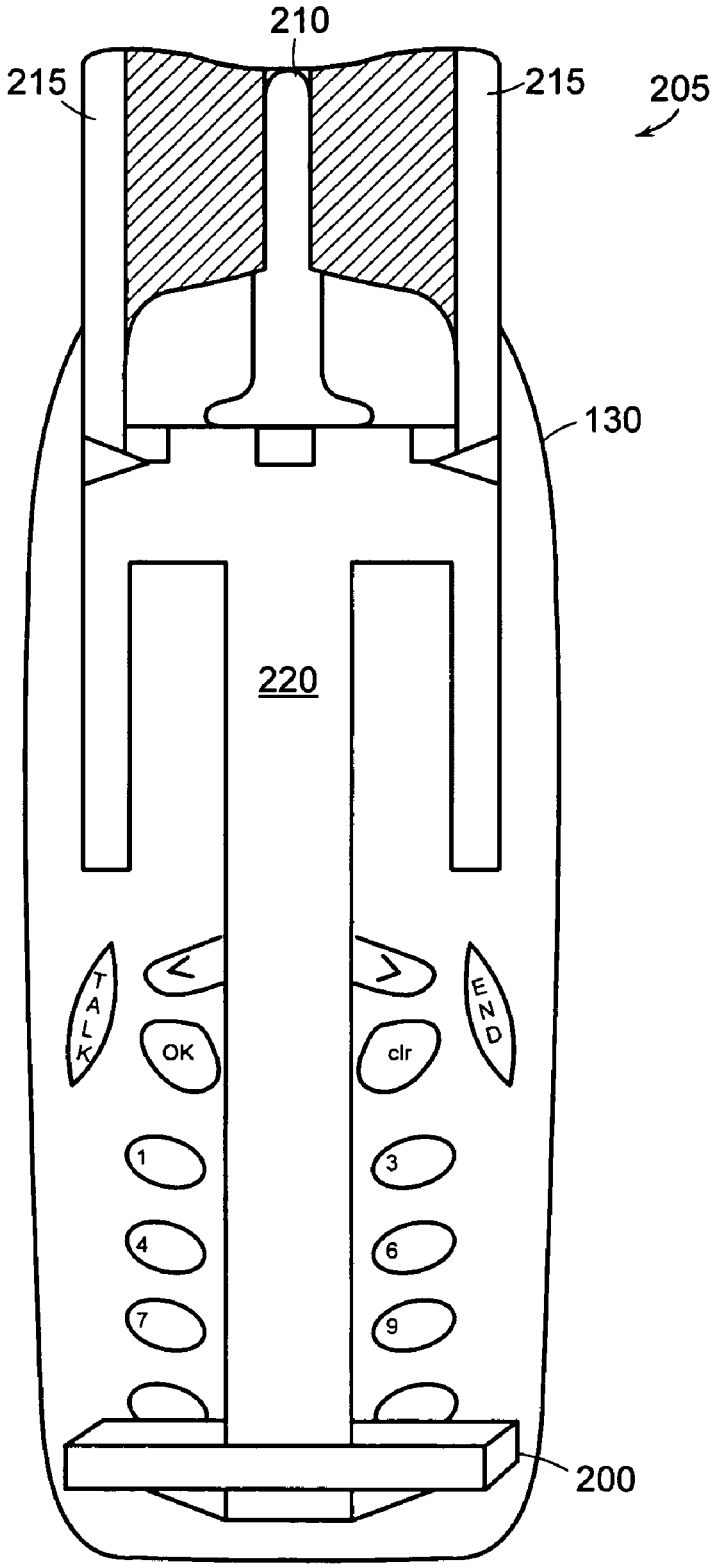
FIG. 2A is a mechanical diagram of a handheld communications device employing a folded monopole antenna according to the principles of the present invention.
Figure 2B:
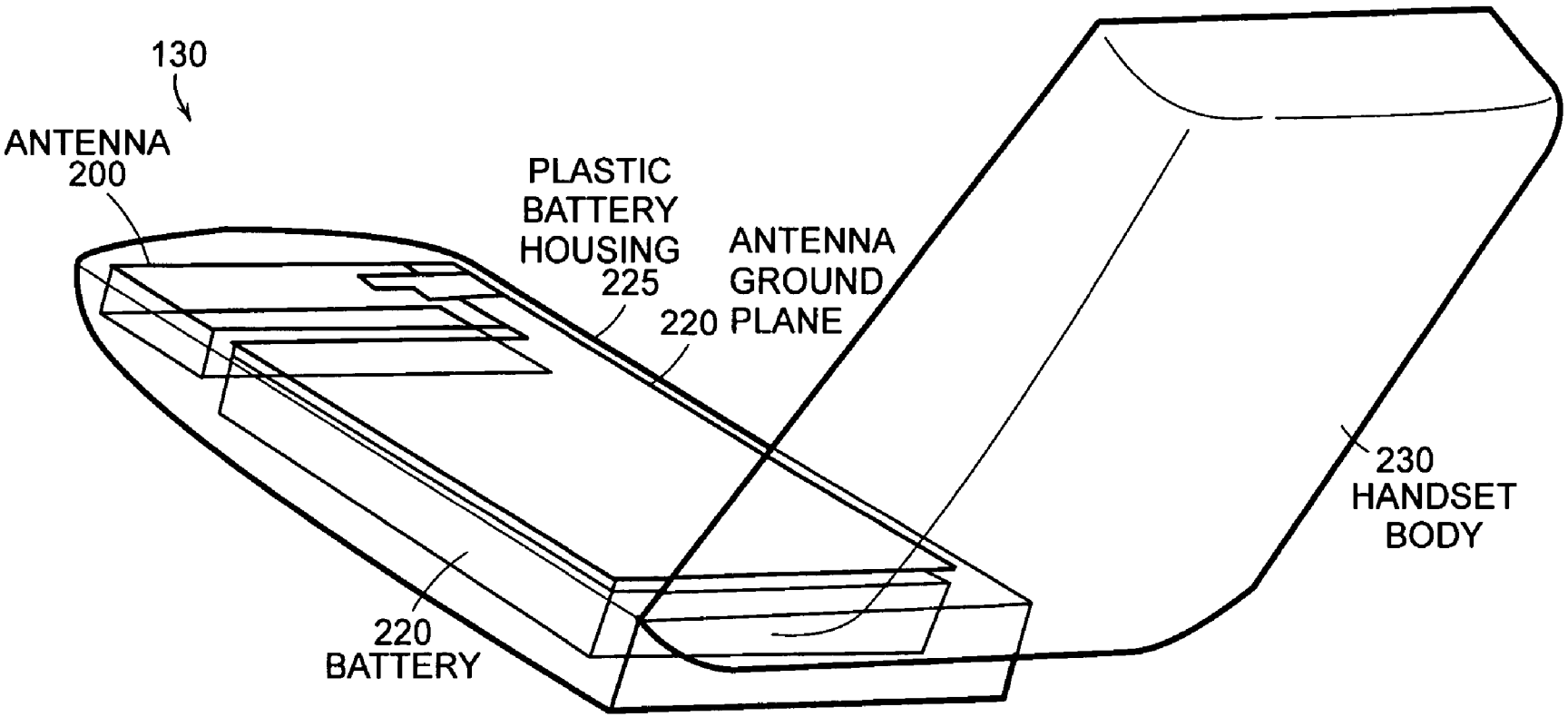
FIG. 2B is a mechanical diagram of an alternative embodiment of a handheld communications device of FIG. 2A.
Figure 2C:
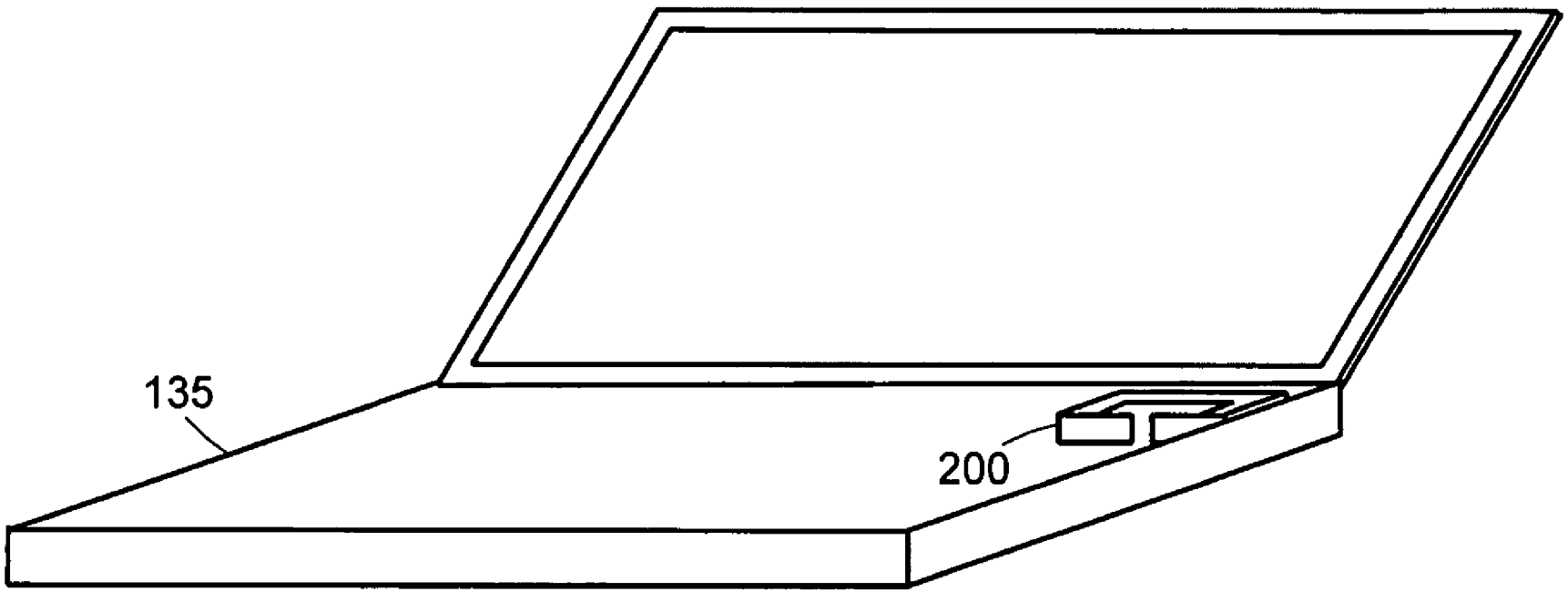
FIG. 2C is a diagram of a personal computer employing the folded monopole antenna of FIG. 2A.

FIGS. 2A-2C are applications in which a folded monopole antenna (also referred to herein as "monopole") according to the principles of the present invention and the above-listed concepts may be employed.

FIG. 2A is a mechanical diagram of a cell phone 130 in which an embodiment of a folded monopole antenna 200 according to the principles of the present invention is employed. The cell phone includes a directional antenna 205 in addition to the folded monopole antenna 200. A ground plane 220 is adapted for use with the directional antenna 205 and extends the length of this cell phone 130 to the folded monopole antenna 200 for coupling thereto.

The directional antenna includes an active antenna element 210 surrounded by a pair of passive antenna elements 215 that are controlled in a dynamic manner, such as described in U.S. Pat. No. 6,600,456, the entire teachings of which are incorporated herein by reference. The directional antenna 205 is used when the frequency bands are well known. In cases where the frequency bands are not well known, such as in cases where different service providers have "segmented" frequencies (i.e., transmit and receive) or in cases where dual use is desired, the monopole 200 is used. For example, dual use may include a legacy cell phone band (e.g., 900 MHz) and non-legacy PCS band (i.e., 1.85 GHz). Another example includes IEEE 802.11(b) or (g) (i.e., 2.4 GHz) and 802.11 (a) (i.e., 5.2 GHz). In either dual use example, the folded monopole antenna 200 can be designed and used at both frequencies and have broad enough bandwidths at each frequency to support service providers' allotted transmit and receive frequencies. The monopole 200 generally has an omni-directional beam pattern but may be modified to produce a more directional beam pattern.

FIG. 2B is an example of another cell phone 130 in which the folded monopole antenna 200 is employed. The cell phone 130 includes a handset body 230 and a plastic battery housing 225. The plastic battery housing 225 encapsulates a battery 220 and the monopole 200. Integrated into the plastic battery housing 225 is the antenna ground plane 220.

It should be understood that the monopole 200 may also be disposed in the handset body 230 with the ground plane 220 extended accordingly. In alternative embodiments, the monopole 200 may be situated in other areas of the cell phone 130, including in a cell phone attachment (not shown).

FIG. 2C is an example application in which the monopole 200 is employed in a personal computer 135 that has wireless communications to a CDMA network or WLAN network. The monopole 200 is illustrated as being located in the PC 135 toward the rear, but may be disposed in alternative regions, including, for example, in a PCMCIA card (not shown) or as a plug-in unit connected to the PC 135 via an RF-compatible bus.

Figure 3A:
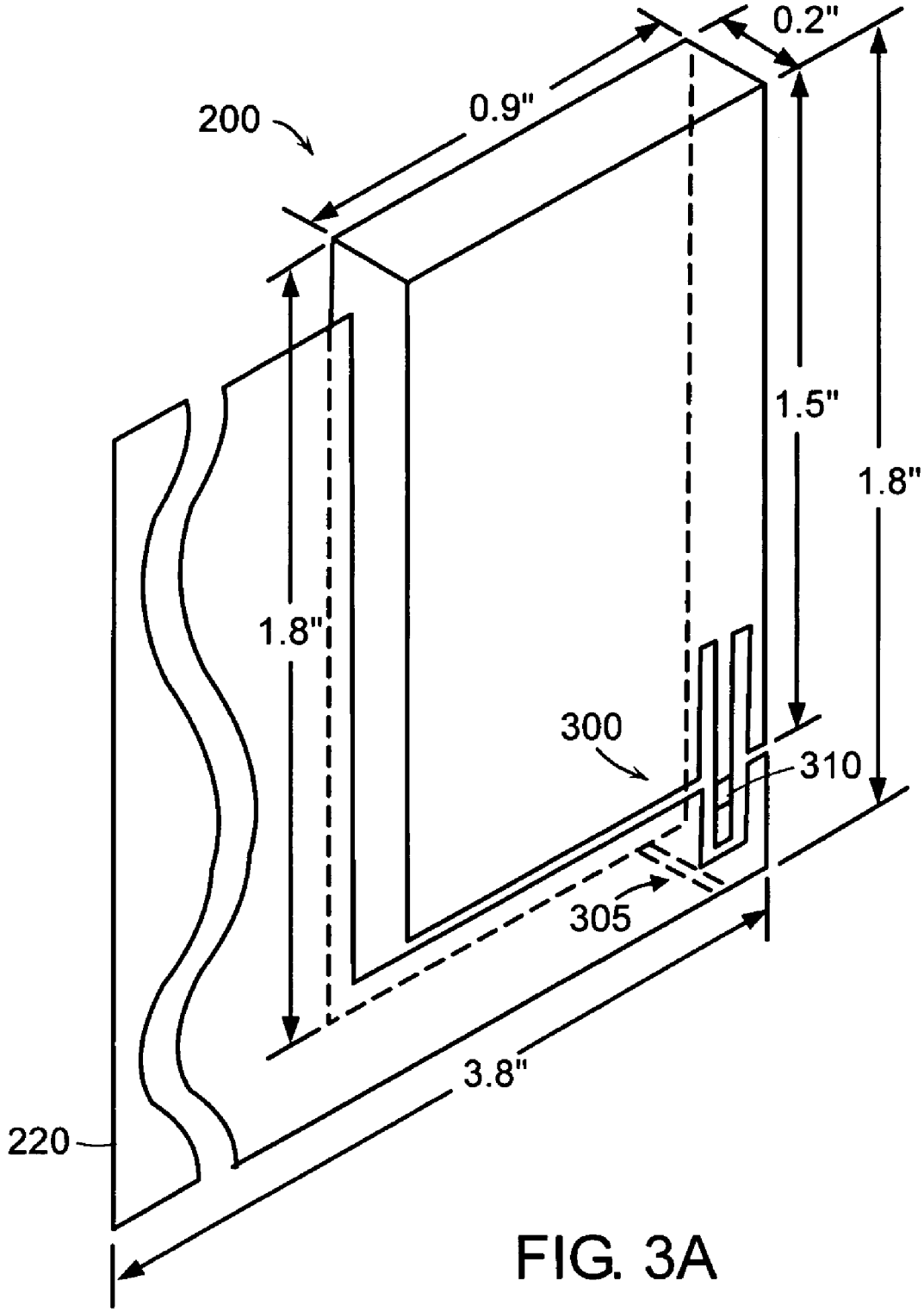
FIGS. 3A-3C are mechanical diagrams of the folded monopole antenna of FIG. 2A.

FIG. 3A shows the folded monopole antenna 200 next to the ground plane 220. The monopole 200 is shown to the right, and the ground plane 220 extends from the lower right to the entire region on the left. The monopole 200 may be constructed from a sheet of metal.

In the embodiment of FIG. 3A, the monopole 200 is mechanically folded at the top twice, thereby forming first ("front") and second ("rear") parallel sections with a third ("top") section connecting the front and rear sections.

The rear section is connected to the ground plane 220 through a line reactance 305. A monopole feed region 300 ("feed") is shown in the lower right. In this embodiment, the feed is a co-planar waveguide, that protrudes into the sheet metal monopole 200 to create an improved radiation resistance. A feed reactance 310 may be added to adjust the input reactance. The line reactance 305 affects the effective length of the folded section, so if made variable, it can be used for frequency adjustment and control of radiation pattern shape. The feed reactance 310 can be made variable to optimize the impedance match.

Figure 3B:
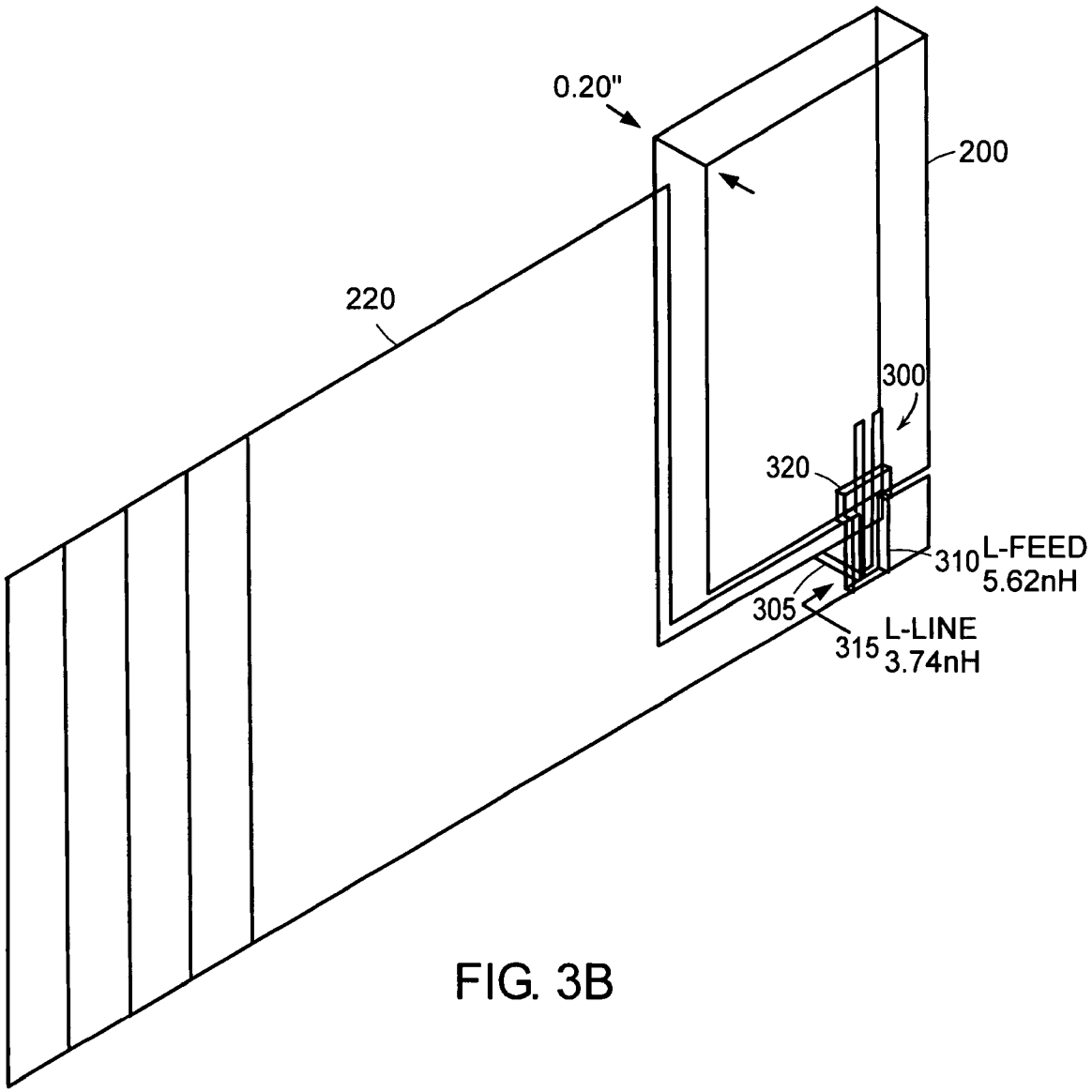

FIG. 3B provides a three-dimensional view of a coaxial connector 320 that facilitates coupling a RF cable and connector assembly (not shown) to the input feed 300 of the monopole 200. Also shown is an inductor 315 installed in the line 305 between the antenna 200 and the ground plane 220. The feed inductor 310 and line inductor 315 may be in the form of a commercially available chip or may be other inductor forms adapted to fit within the confines of their respective locations. In one embodiment, the input feed inductor 310 is 5.62 nH, and the line inductor 315 is 3.74 nH.

The input feed inductor 310 and line inductor 315 may be electronically controlled to change the values during an initialization process or during operation. Reasons for changing the values of the line inductor 315 include changing a center frequency in a bandwidth supported by the monopole 200.

Figure 3C:
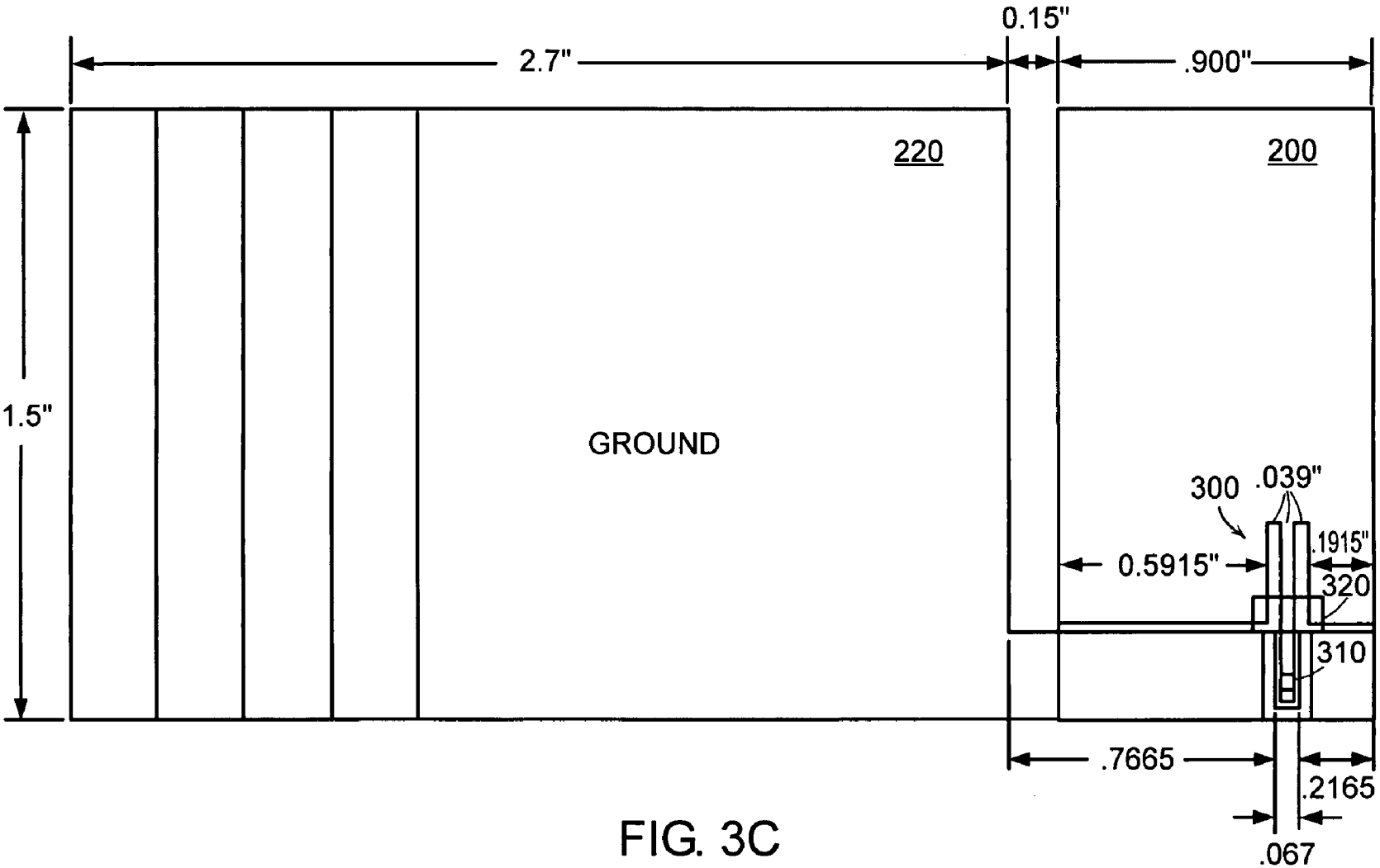

FIG. 3C is a two-dimensional mechanical diagram of the monopole 200 and ground plane 220. Example dimensions are for a cell phone application and are indicated in English units. Also, the input feed 300 includes dimensions in English units. In this example, the input feed 300 is a co-planar waveguide that matches an input impedance with a coaxial line (not shown) connected to the connector assembly 320. The co-planar waveguide extends a given depth into the monopole that may be longer than necessary to allow for a broad range of radiation resistances with manual adjustment. To adjust the radiation resistance, conductive tape or a conductive slider (not shown) may be applied to the co-planar waveguide. In the case of the slider, the slider may be set on rails or other mechanism(s) that are connected to the monopole 200 in a manner facilitating slide-and-hold capability so as to maintain the selected performance once set. Various latching or locking mechanisms may be employed with a slider used for this purpose.

Figure 4A:
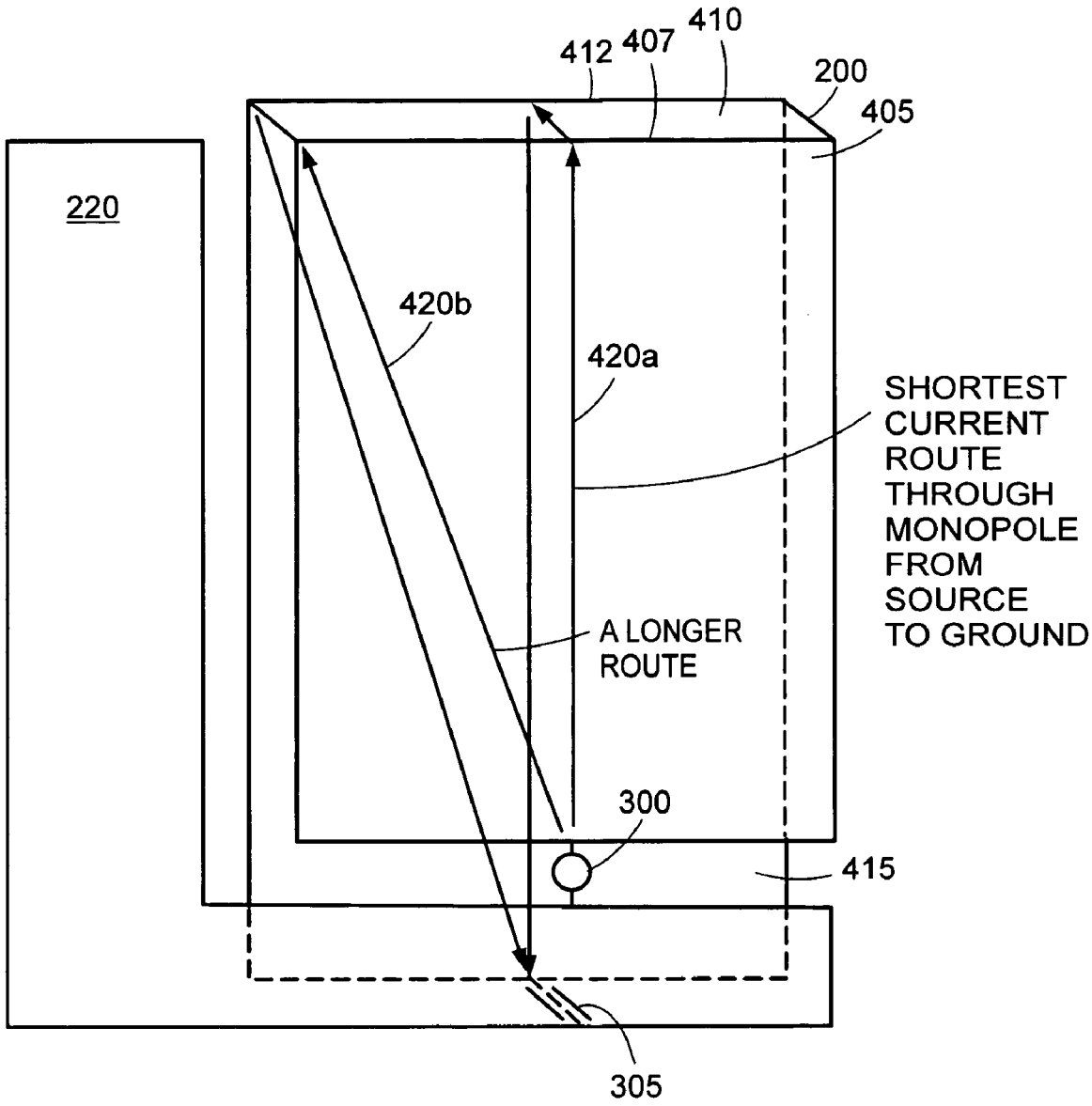
FIGS. 4A-4D are Radio Frequency (RF) current path diagrams of centered and off-center embodiments of the folded monopole antenna of FIG. 3A.

FIG. 4A is a diagram illustrating paths taken by an RF signal traversing from the input feed 300 to the line connecting between the monopole 200 and the associated ground plane 220. Before describing the paths, some terminology is provided to describe the monopole 200 in further detail.

In this embodiment of the monopole 200, the monopole is folded into three sections: a first (or front) section 405, a second (or rear) section 415, and a third (or top) section 410. In this embodiment, intersections between the front and rear sections 405, 415 and the top section 410 are folds 407 and 412, respectively, which are preferably 90 degrees, but may be different angles in alternative embodiments. Further, the top section 410 may be rounded or another shape in another embodiment. In yet another embodiment, the folds 407 and 412 may be connections suitable for use in RF applications described herein.

Referring now to the arrows indicating RF current paths 420*a* and 420*b* (collectively 420) that are depicted extending along the sections 405, 410, 415 from the input feed 300 to the ground line 305. A first path 420*a* extends directly upward from the bottom of the front section 405 to the top of the front section, travels across the top section 410 to the rear section 415, and projects vertically from the top of the rear section 415 to the ground line 305. This first path 420*a* is the shortest current path through the monopole 200 from the source (i.e., connector 320 connected to the input feed 300) to the ground 220. A second route 420*b* is shown by way of arrows as extending diagonally from the input feed 300 to the top left corner of the front section 405, travels across the left edge of the top section 410, and projects diagonally from the top left corner of the rear section 415 to the ground line 305.

Figure 4B:
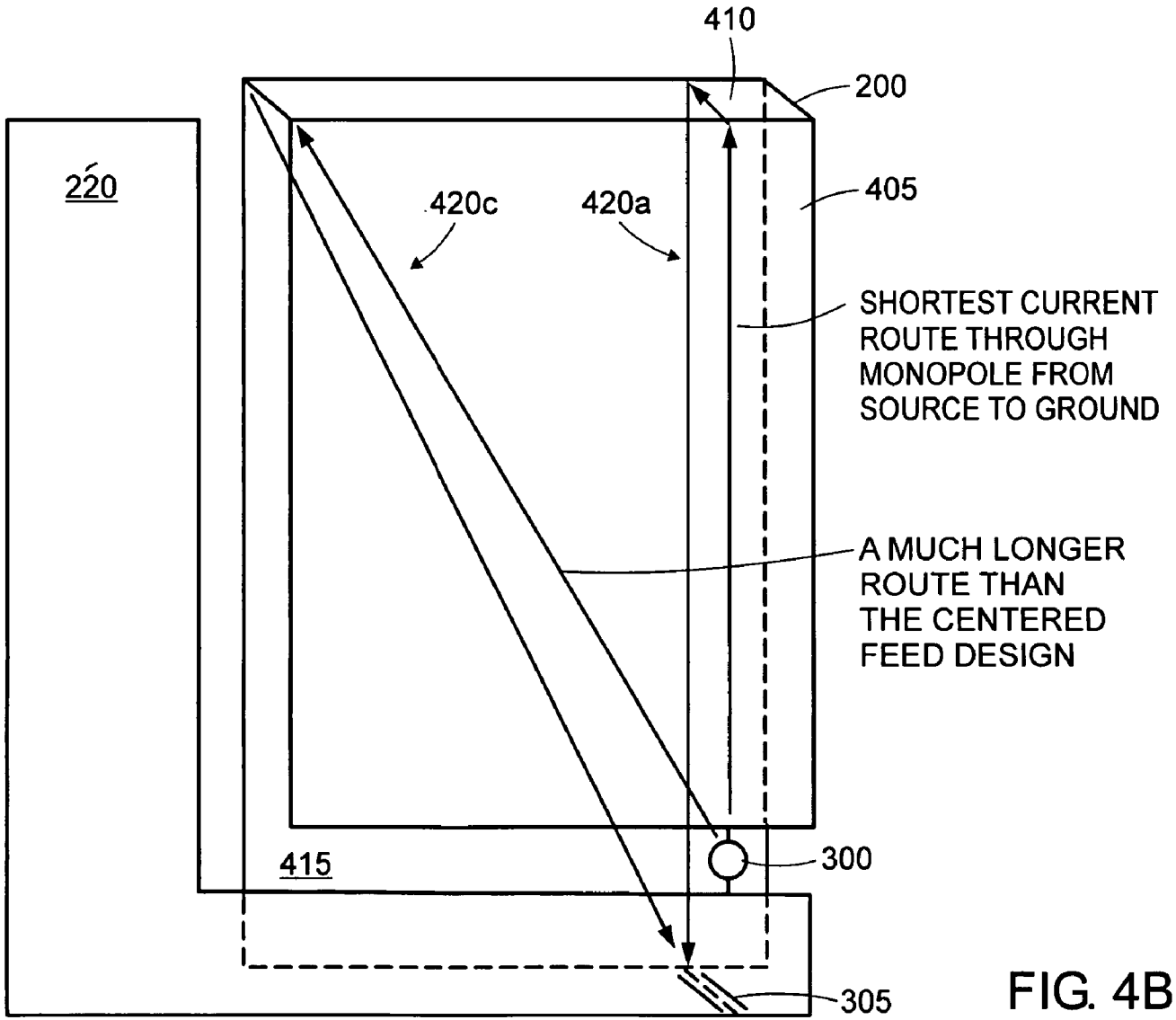

FIG. 4B illustrates another embodiment of the monopole in which the input feed 300 is located (i.e., offset) toward the right side of the front section 405. The ground line 305 is also located (i.e., offset) toward the right side of the rear section 415. The corresponding first path 420*a* (i.e., shortest RF current path) through the monopole 200 from the input feed 300 to the ground 220 is the same length as when the input feed 300 is located (i.e., centered) at the vertical center (i.e., "centerline") in this orientation of the monopole 200. However, as indicated by another set of arrows, a diagonal current path 420*c* is longer than the diagonal current path 420*b* when the input feed 300 and ground line 305 are located at the centerline. This increased diagonal current path 420*c* increases the bandwidth supported by the monopole 200, discussed in detail below in reference to FIGS. 5, 6A, and 6B.

Before generalizing the frequency and bandwidth properties of the monopole 200, further discussions of RF current paths are described.

Figure 4C:
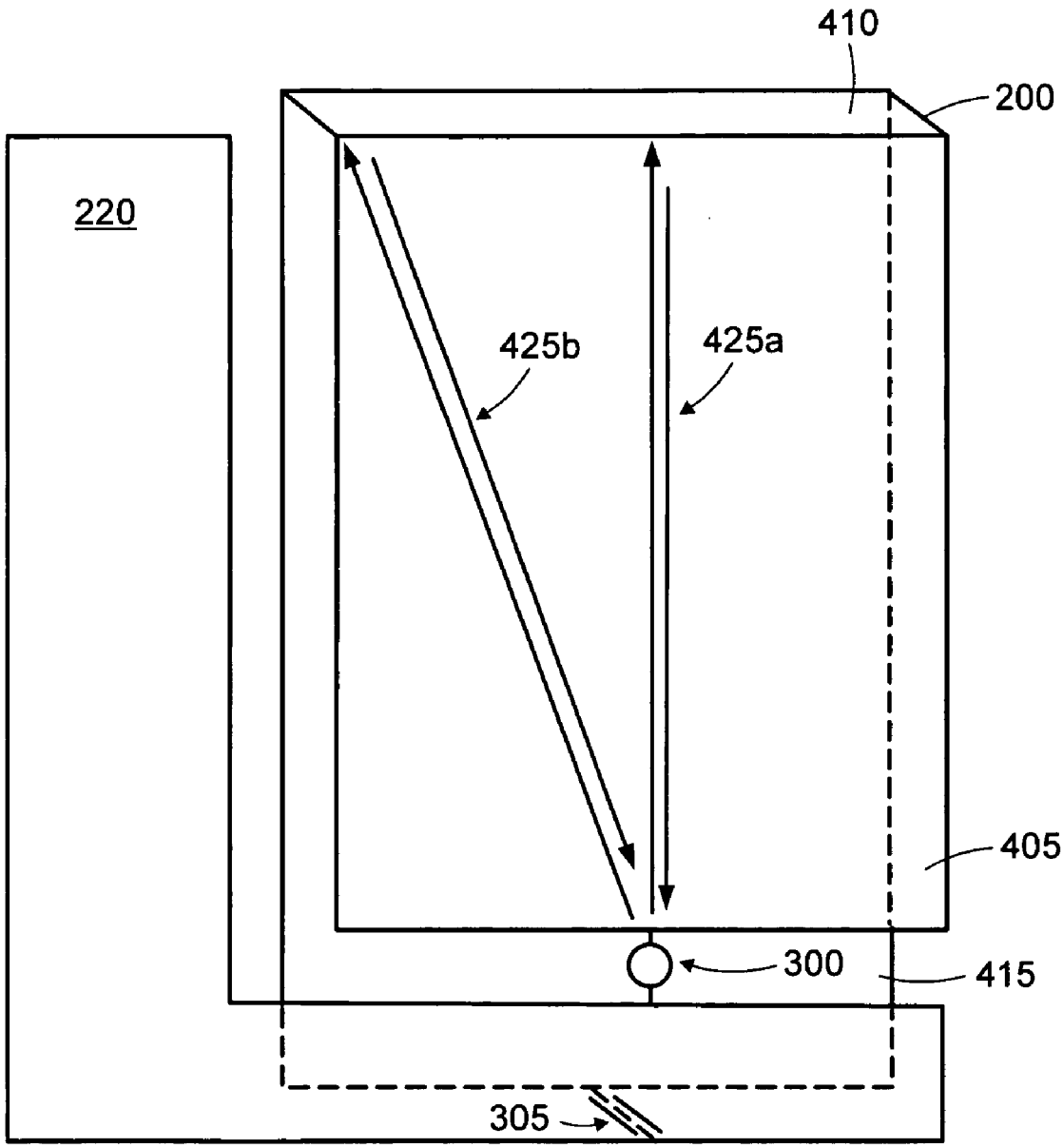

FIG. 4C is the same configuration of the monopole 200 as described above in reference to FIG. 4A. In FIG. 4C, the input feed 300 and ground line 305 are again centered. Arrows illustrating RF current paths traveling up and down the front section 405 of the monopole 200 are shown. A shortest current path 425*a* extends directly up and down the front section 405. A longer current path 425*b* is represented by longer, diagonal arrows.

Figure 4D:
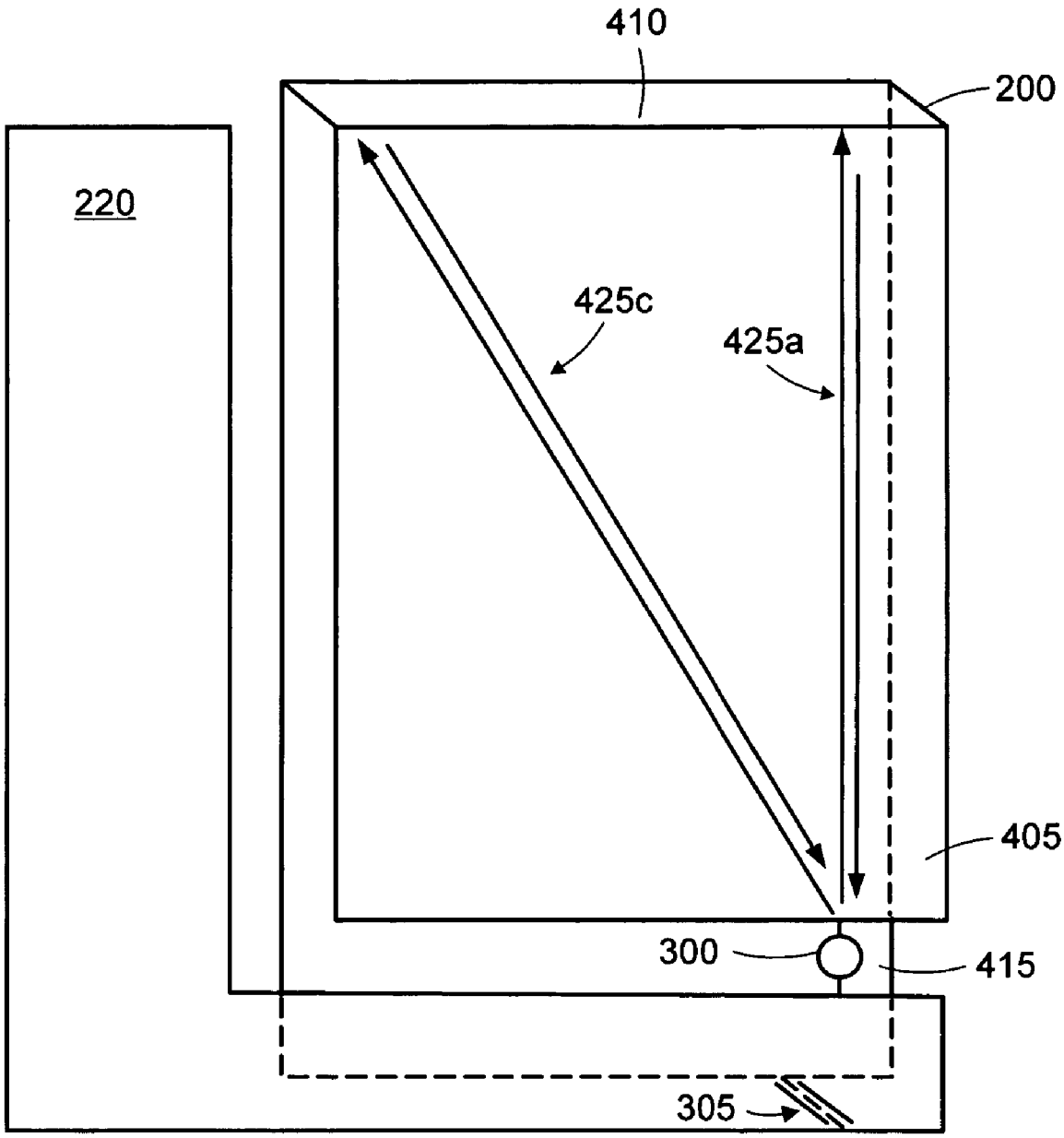

FIG. 4D is the same configuration of the monopole 200 as described above in reference to FIG. 4B with the input feed 300 and ground line 305 offset. The shortest current path 425*a* is again shown by way of arrows, and a longer current path 425*c* is again shown by way of diagonal arrows.

The dimensions of the two-dimensional sections 405 and 415 defining the monopole 200 essentially define the frequency characteristics of the monopole 200. However, it should be understood that the dimensions of the top section 410 and other RF current effects, such as scattering, contribute to the frequency characteristics.

Figure 5:
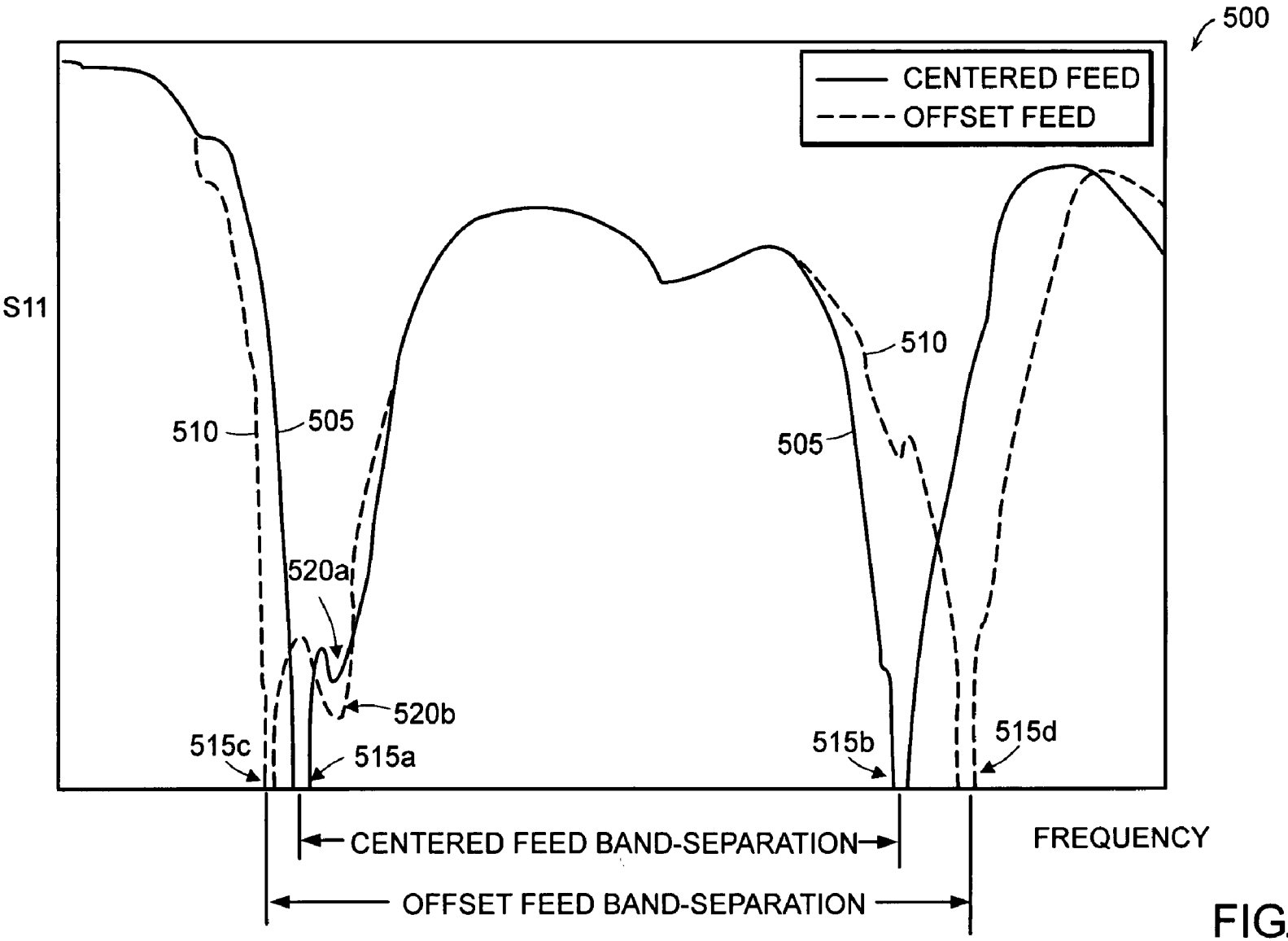
FIG. 5 is a spectral diagram indicating frequency matching of the folded monopole antenna of FIG. 3A as determined through simulations.

FIG. 5 is a spectral diagram generated through simulation corresponding to the monopole 200 of FIGS. 4A-4D, with dimensions specified in FIGS. 3A-3C. The spectral diagram 500 includes two curves: a centered feed curve 505 and an offset feed curve 510. The terms "centered" and "offset" correspond to the location of the input feed 300 on the front section 405 and the location of the ground line 305 on the rear section 415. The centered feed curve 505 and offset feed curve 510 have "good" frequency matching characteristics (i.e., resonances) at three locations each. The centered feed curve 505 has frequency matching characteristics at points 515*a*, 515*b*, and 520*a*. The offset feed curve 510 has good matching characteristics at points 55*c*, 515*d*, and 520*b*. It should be noted that the centered feed band separation (i.e., distance between points 515*a* and 515*b* and points 515*c* and 515*d*) are closer for the centered feed configuration of FIGS. 4A and 4C than the offset feed configuration of FIGS. 4B and 4D. The reason for the band separation differences reflects the differences in lengths of the diagonal current paths 420*b* (FIG. 4A) and 420*c* (FIG. 4B).

The frequency characteristics illustrated by the curves 505, 510 in FIG. 5 correspond to the dimensions of the folded monopole antenna as follows. The lowest resonance 515*a* and 515*c* of each of the curves 505 and 510, respectively, is determined by the total current path traveled by an RF signal between the input feed 300 and the ground line 305. The second lowest resonance 520*a*, 520*b* of the curves 505, 510 is determined by the non-diagonal current paths shown in FIGS. 4A and 4B.

As can be seen, the lowest resonance 515*c* is created by shifting the input feed 300 far away from the centerline of the monopole 200 and also shifting the ground line 305 far away from the centerline in the same direction (see FIG. 4B). Since the shortest current path between the input feed 300 and the ground line 305 remains the same whether the input feed 300 and ground line 305 is at the centerline or toward one end of the monopole, the bandwidth at the low frequency is wider when the source and ground line are offset. In other words, the difference in path lengths between centered and offset configurations determines the bandwidth.

The high frequency resonance 515*b* and 515*d* are determined by the height of the front section 405. Similar to the low frequency bandwidth, the high frequency bandwidth is determined by the difference in round trip path length of the shortest current path 425*a* and longer path lengths 425*b*, 425*c* of the front section 405, as illustrated in FIGS. 4C and 4D.

Therefore, changing the frequency characteristics of the monopole 200 can be done by changing dimensions of the front section 405 or rear section 415. Also, the ground line 305 or ground line inductor 315 (FIG. 3B) can be used to slightly adjust or fine tune the center of the low frequency band. More inductance extends the effective electrical length of the path between the input feed 300 and the ground plane 220, and lesser inductance shortens this effective electrical length. It should be understood that the resonances, or lowest points, in the spectral plot of FIG. 5 indicate points where inductances and capacitances in the monopole 200 cancel each other at a given frequency, and only resistance is left, as is well understood in the art.

Figure 6A:
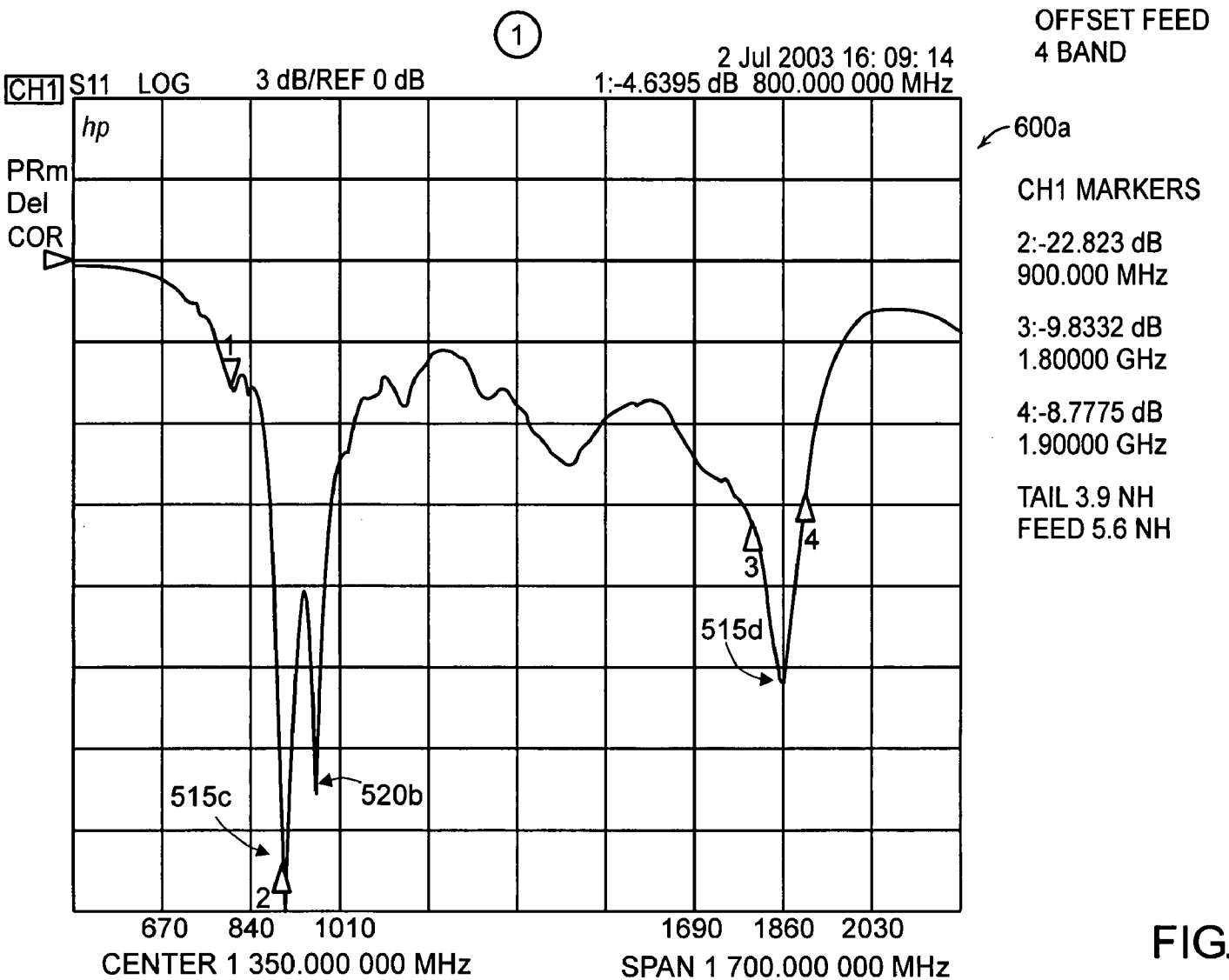
FIG. 6A is a measured spectral diagram including a curve indicating frequency matching of the folded monopole antenna of FIG. 4B.

FIG. 6A is a measured spectral plot 600*a* for the folded monopole antenna 200 of FIGS. 3A-3C with feed inductance 310 of 5.6 nH and ground line 305 and ground line inductance 315 of 3.9 nH. Marker # 2 at the lowest resonance 515*c* is observed at 900 MHz, and the next resonance is at approximately 1.0 GHz. The highest resonance 515*d* is observed at approximately 1.85 GHz, with markers # 3 and # 4 at 1.8 GHz and 1.9 GHz, respectively. The measurements are for the offset feed embodiments of FIGS. 4B and 4D, which have a wider bandwidth than the embodiment of the centered input feed and ground line of FIGS. 4A and 4C, as discussed above.

Figure 6B:
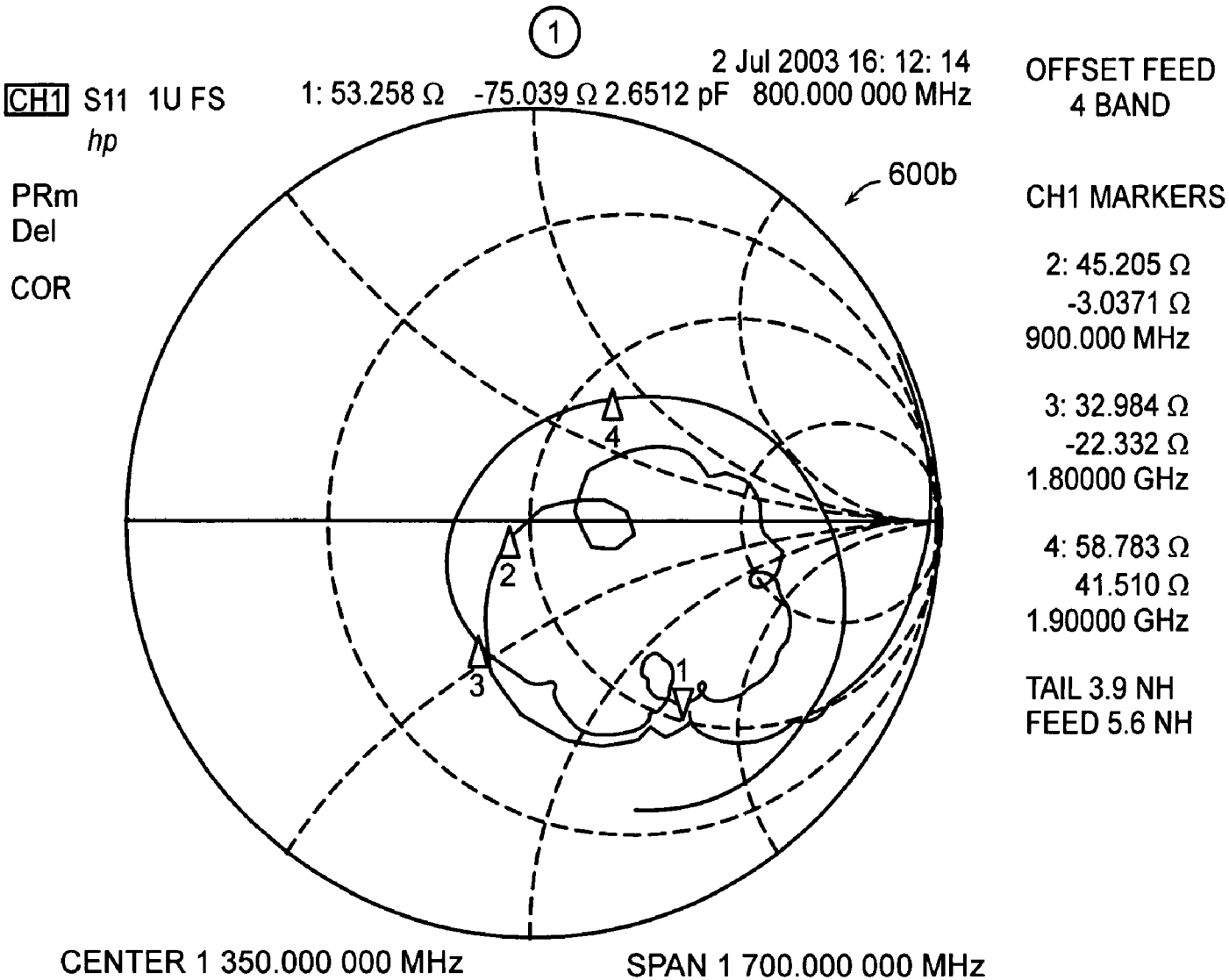
FIG. 6B is a Smith chart including a curve corresponding to the measured spectral diagram of FIG. 6A.

FIG. 6B is a Smith chart 600*b* corresponding to the measured spectral response of the monopole 200 as depicted by the curve of FIG. 6A. Standard Smith chart analyses apply.

Figure 7:
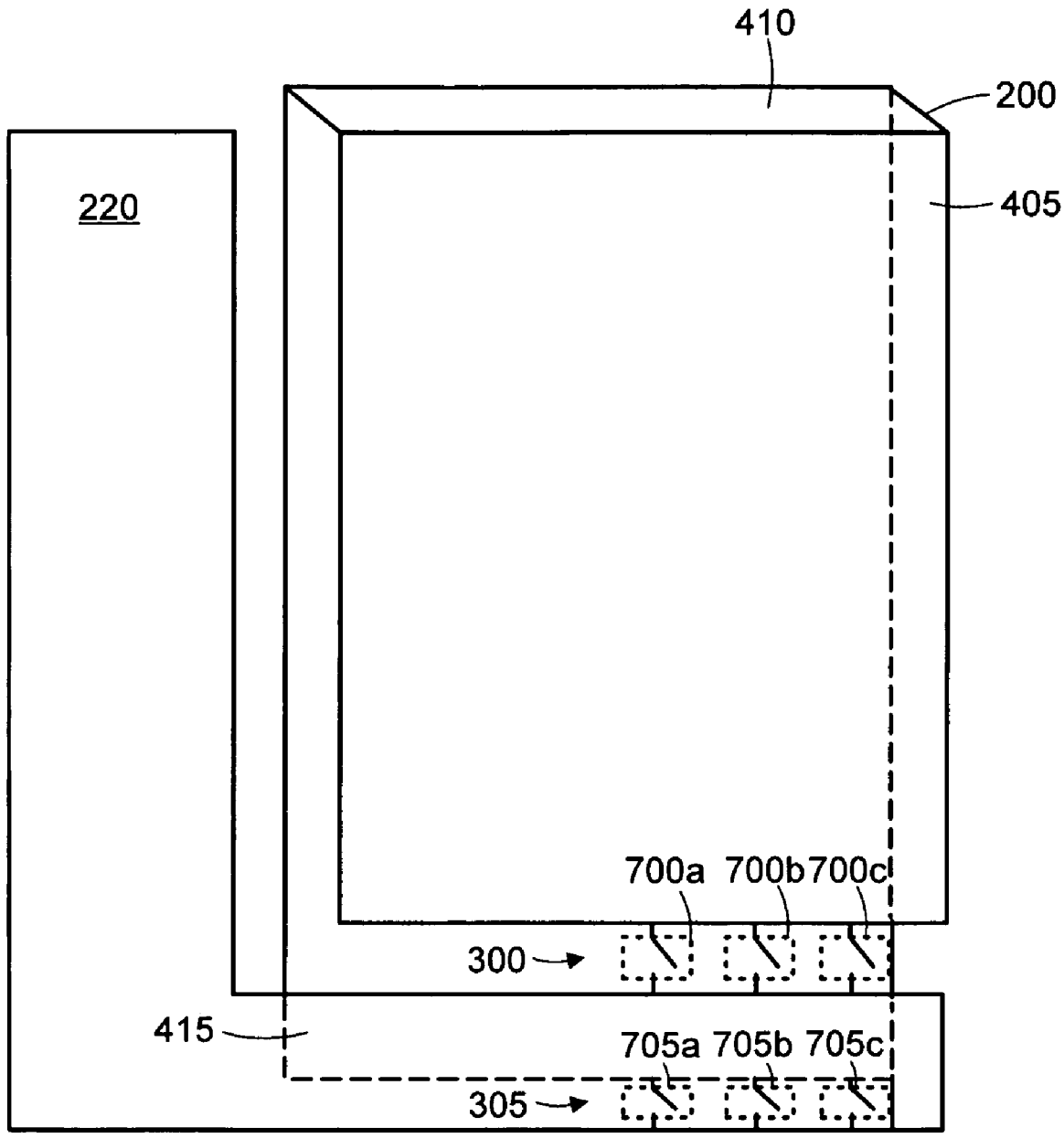
FIG. 7 is another embodiment of the folded monopole antenna of FIG. 3A.

FIG. 7 is an alternative embodiment of the monopole 200 of FIG. 4A. In this embodiment, multiple input feeds 300 and ground lines 305 are selectively enabled or disabled through use of RF switches. Specifically, the input feeds are selectively enabled or disabled by switches 700*a*, 700*b* and 700*c* (collectively 700). The ground lines are selectively enabled or disabled through switches 705*a*, 705*b*, and 705*c* (collectively 705). Activation or deactivation of any of the switches 700 or 705 may be done during a configuration cycle or during operation. Thus, the bandwidths can be selectively adjusted during configuration or operation.

In other embodiments, the input lines 300 and ground lines 305 may also be disposed on the side of the front section 405 and rear section 415 to substantially change the resonance frequencies and respective bandwidths. Similarly, inductances or other reactance elements including inductors, capacitors, lumped impedances, shorts, opens, delay lines, or other means to shorten or lengthen the actual or effective RF current paths 420, 425 (FIGS. 4A-4D) may be adjusted through electrical or mechanical means during configuration or operation of the monopole 200.

While this invention has been particularly shown and described with references to preferred embodiments thereof, it will be understood by those skilled in the art that various changes in form and details may be made therein without departing from the scope of the invention encompassed by the appended claims.

What is claimed is:

1. A folded monopole antenna, comprising:

a first planar section, having a first dimension and a second dimension, that forms a substantially continuous surface over the first and second dimensions, the first dimension substantially defining a first resonance frequency supported by the folded monopole antenna;

a second planar section, having a first dimension and a second dimension, that forms a substantially continuous surface over the first and second dimensions, the second planar section substantially parallel to the first planar section, the first and second planar sections having respective first and second dimensions combining to substantially define a second resonance frequency supported by the folded monopole antenna;

a third section coupling the first planar section to the second planar section;

an input feed coupled to the first planar section at a first location being at a first non-zero distance from the third section and adapted to feed Radio Frequency (RF) signals to or from the folded monopole antenna and an external device, a distance between the first location and a centerline of the first planar section contributing to a first bandwidth at the first resonance frequency; and a reactance coupled to the second planar section and a ground plane at a second location of the second planar section being at a second non-zero distance from the third section, a distance between the first and second locations from a centerline of the first and second planar sections contributing to a second bandwidth supported by the folded monopole antenna at the second resonance frequency, wherein the first non-zero distance and the second non-zero distance are substantially the same.

2. The folded monopole antenna according to claim 1 wherein the reactance is selectable between and including a short and an open to fine tune the second resonance frequency.

3. The folded monopole antenna according to claim 2 wherein the reactance is selectable during operation of the folded monopole antenna.

4. The folded monopole antenna according to claim 1 wherein the reactance includes multiple reactances distributed between the second planar section and the ground plane.

5. The folded monopole antenna according to claim 4 further including multiple respective switches to couple the second planar section and the ground plane at at least one selectable location.

6. The folded monopole antenna according to claim 1 wherein the input feed is among multiple input feeds distributed on the first planar section.

7. The folded monopole antenna according to claim 6 further including respective switches to enable the input feeds.

8. The folded monopole antenna according to claim 1 wherein the input feed includes a reactance for input matching.

9. The folded monopole antenna according to claim 1 wherein the input feed is a co-planar waveguide.

10. The folded monopole antenna according to claim 9 further including a mechanism associated with the co-planar waveguide adjustably configured to change a radiation resistance of the co-planar waveguide.

11. The folded monopole antenna according to claim 1 wherein the first bandwidth includes 900 MHz and second bandwidth includes 1.85 GHz.

12. The folded monopole antenna according to claim 1 wherein the first bandwidth includes 2.4 GHz and second bandwidth includes 5.2 GHz.

13. The folded monopole antenna according to claim 1 used in a handheld communications device.

14. The folded monopole antenna according to claim 1 used in a wireless local area network device.

15. The folded monopole antenna according to claim 1 wherein the first non-zero distance and the second non-zero distance are different from one another.

16. The folded monopole antenna according to claim 1 wherein the first non-zero distance defines a current path along the first planar section between the input feed and the third section.

17. The folded monopole antenna according to claim 16 wherein the current path is at least about a quarter inch.

18. The folded monopole antenna according to claim 1 wherein the second non-zero distance defines a current path along the second planar section between the reactance and the third section.

19. The folded monopole antenna according to claim 18 wherein the current path is at least about a quarter inch.

20. The folded monopole antenna according to claim 1 wherein the third section coupling the first planar section to the second planar section is rounded.

21. A method of operating a folded monopole antenna, comprising:

associating a Radio Frequency (RF) signal with a first planar section having a first dimension and a second dimension, that forms a substantially continuous surface over the first and second dimensions, the first dimension substantially defining a first resonance frequency supported by the folded monopole antenna;

associating the RF signal with a second planar section, having a first dimension and a second dimension, that forms a substantially continuous surface over the first and second dimensions, the second planar section substantially parallel to the first planar section, the first and second planar sections having respective first and second dimensions combining to substantially define a second resonance frequency supported by the folded monopole antenna;

transmitting or receiving the RF signal between the folded monopole antenna and an external device at a first location being at a first non-zero distance from a third section between the first and the second planar sections, a distance between the first location and a centerline of the first planar section contributing to a first bandwidth at the first resonance frequency; and coupling the RF signal to a ground plane via a reactance at a second location of the second planar section being at a second non-zero distance from the third section between the first and the second planar sections, a distance between the first and second locations from a centerline of the respective first and second planar sections contributing to a second bandwidth supported by the folded monopole antenna at the second resonance frequency, wherein the first non-zero distance and the second non-zero distance are substantially the same.

22. The method according to claim 21 wherein coupling the RF signal to a ground plane via a reactance includes selecting a reactance between and including a short and an open to tune the second resonance frequency.

23. The method according to claim 22 wherein selecting the reactance includes selecting the reactance during operation of the folded monopole antenna.

24. The method according to claim 21 further including facilitating multiple reactances distributed between the second planar section and the ground plane.

25. The method according to claim 24 further including operating multiple respective switches associated with the multiple reactances to couple the second planar section and the ground plane at at least one selectable location.

26. The method according to claim 21 wherein transmitting or receiving the RF signal between the folded monopole antenna and an external device includes selecting an input feed among multiple input feeds distributed on the first planar section.

27. The method according to claim 26 further including operating respective switches associated with the multiple input feeds to enable at least one of the multiple input feeds.

28. The method according to claim 21 wherein transmitting or receiving the RF signal between the folded monopole antenna and an external device includes adjusting a reactance of an input feed for input matching.

29. The method according to claim 21 wherein transmitting or receiving the RF signal between the folded monopole antenna and an external device includes transmitting the RF signal to the first planar section via a co-planar waveguide.

30. The method according to claim 29 further including facilitating adjustment of the co-planar waveguide to enable a user to change a radiation resistance of the co-planar waveguide.

31. The method according to claim 21 wherein the first bandwidth includes 900 MHz and the second bandwidth includes 1.85 GHz.

32. The method according to claim 21 wherein the first bandwidth includes 2.4 GHz and second bandwidth includes 5.2 GHz.

33. The method according to claim 21 used in a handheld communications device.

34. The method according to claim 21 used in a wireless local area network device.

35. A folded monopole antenna, comprising:

first means for substantially defining a first resonance frequency supported by the folded monopole antenna, said first means having a first dimension and a second dimension and being a substantially continuous surface over the first and second dimensions;

second means substantially parallel to the first means and having a first dimension and a second dimension and being a substantially continuous surface over the first and second dimensions, the first and second means for combining to substantially define a second resonance frequency supported by the folded monopole antenna;

third means for associating the first planar section with the second planar section;

input means for feeding Radio Frequency (RF) signals to or from the folded monopole antenna and an external device at a first location of the first means and being at a first non-zero distance from the third means and being at a distance between the first location and a centerline of the first means contributing to a first bandwidth at the first resonance frequency; and reactance means for coupling the second planar section and a ground plane at a second location of the second means and being at a second non-zero distance from the third means and being at a distance between the first and second locations from a centerline of the respective first and second means contributing to a second bandwidth supported by the folded monopole antenna at the second resonance frequency, wherein the first non-zero distance and the second non-zero distance are substantially the same.

36. A method of manufacturing a folded monopole antenna, comprising:

forming a first planar section, having a first dimension and a second dimension, that forms a substantially continuous surface over the first and second dimensions, the first dimension substantially defining a first resonance frequency supported by the folded monopole antenna;

forming a second planar section, having a first dimension and a second dimension, that forms a substantially continuous surface over the first and second dimensions, the second planar section substantially parallel to the first planar section, the first and second planar sections having respective first and second dimensions combining to substantially define a second resonance frequency supported by the folded monopole antenna;

forming a third section coupling the first planar section to the second planar section;

forming an input feed coupled to the first planar section at a first location and adapted to feed Radio Frequency (RF) signals to or from the folded monopole antenna and an external device, the input feed being at a first non-zero distance form the third section and a distance between the first location and a centerline of the first planar section contributing to a first bandwidth at the first resonance frequency; and adding a reactance to the second planar section adapted to couple the second planar section and a second ground plane at a second location of the second planar section, the reactance being at a second non-zero distance from the third section and a distance between the first and second locations from a centerline of the respective first and second planar sections contributing to a second bandwidth supported by the folded monopole antenna at the second resonance frequency, wherein the first non-zero distance and the second non-zero distance are substantially the same.

37. The method according to claim 36 wherein adding the reactance includes adding a reactance selectable between and including a short and an open to fine tune the second resonance frequency.

38. The method according to claim 37 further including selecting the reactance during operation of the folded monopole antenna.

39. The method according to claim 36 wherein adding the reactance includes adding multiple reactances distributed between the second planar section and the ground plane.

40. The method according to claim 39 further including integrating multiple respective switches to couple the second planar section and the ground plane at at least one selectable location.

41. The method according to claim 36 wherein forming the input feed includes forming multiple input feeds distributed on the first planar section.

42. The method according to claim 41 further including coupling multiple respective switches to enable at least one of the multiple input feeds.

43. The method according to claim 36 wherein forming the input feed includes associating a reactance with the input feed for matching.

44. The method according to claim 36 wherein forming the input feed includes forming a co-planar waveguide.

45. The method according to claim 44 further including associating a mechanism with the co-planar waveguide adjustably configured to change a radiation resistance of the co-planar waveguide.

46. The method according to claim 36 wherein the first bandwidth includes 900 MHz and second bandwidth includes 1.85 GHz.

47. The method according to claim 36 wherein the first bandwidth includes 2.4 GHz and the second bandwidth includes 5.2 GHz.

48. The method according to claim 36 wherein the folded monopole antenna is adapted to be used in a handheld communications device.

49. The method according to claim 36 wherein the folded monopole antenna is adapted to be used in a wireless local area network device.

* * * * *

UNITED STATES PATENT AND TRADEMARK OFFICE

CERTIFICATE OF CORRECTION

PATENT NO. : 7,268,731 B2
APPLICATION NO. : 10/895813
DATED : September 11, 2007
INVENTOR(S) : Chiang et al.

It is certified that error appears in the above-identified patent and that said Letters Patent is hereby corrected as shown below:

At column 7, line 48, after the word "points", delete "55c" and insert therefor --515c--.

IN THE CLAIMS

At claim 36, column 12, line 32, before the words "the third", delete "form" and insert therefor --from--.

Signed and Sealed this

Twentieth Day of May, 2008

JON W. DUDAS
*Director of the United States Patent and Trademark Office*